US007051441B2

(12) United States Patent
Carter, III

(10) Patent No.: US 7,051,441 B2
(45) Date of Patent: May 30, 2006

(54) LEAF SPRING ASSISTED OPENER

(75) Inventor: Fred J. Carter, III, Wichita Falls, TX (US)

(73) Assignee: United Cutlery Corporation, Sevierville, TN (US)

( * ) Notice: Subject to any disclaimer, the term of this patent is extended or adjusted under 35 U.S.C. 154(b) by 0 days.

(21) Appl. No.: 10/944,022

(22) Filed: Sep. 17, 2004

(65) Prior Publication Data

US 2006/0059694 A1 Mar. 23, 2006

(51) Int. Cl.
*B26B 1/04* (2006.01)

(52) U.S. Cl. ..... 30/161; 30/160

(58) Field of Classification Search ..... 30/155, 30/158, 159, 160, 161
See application file for complete search history.

(56) References Cited

U.S. PATENT DOCUMENTS

| | | | | | |
|---|---|---|---|---|---|
| 273,858 | A * | 3/1883 | Korn | | 30/159 |
| 592,612 | A * | 10/1897 | Johnson | | 30/159 |
| 698,080 | A * | 4/1902 | Treas | | 30/159 |
| 4,347,665 | A * | 9/1982 | Glesser | | 30/161 |
| 4,404,748 | A | 9/1983 | Wiethoff | | |
| 5,060,379 | A | 10/1991 | Neely | | |
| D348,599 | S | 7/1994 | Sakai | | |
| D348,818 | S | 7/1994 | Hasegawa | | |
| 5,440,814 | A | 8/1995 | Hall et al. | | |
| 5,511,310 | A | 4/1996 | Sessions et al. | | |
| D378,982 | S | 4/1997 | Thompson | | |
| 5,802,722 | A | 9/1998 | Maxey et al. | | |
| 5,826,340 | A * | 10/1998 | Hull | | 30/161 |
| 6,145,202 | A | 11/2000 | Onion | | |
| 6,308,420 | B1 | 10/2001 | Moser | | |
| 6,434,831 | B1 * | 8/2002 | Chen | | 30/161 |
| D473,917 | S | 4/2003 | Carter, III | | |
| 6,651,344 | B1 | 11/2003 | Cheng | | |
| D489,956 | S | 5/2004 | Rae | | |
| 6,834,432 | B1 * | 12/2004 | Taylor, Jr. | | 30/161 |
| 2002/0104220 | A1 * | 8/2002 | Marfione | | 30/160 |
| 2004/0020058 | A1 * | 2/2004 | Vallotton | | 30/160 |
| 2004/0154170 | A1 * | 8/2004 | Kain et al. | | 30/161 |

* cited by examiner

*Primary Examiner*—Hwei-Siu Payer
(74) *Attorney, Agent, or Firm*—Pitts & Brittian, P.C.

(57) ABSTRACT

A leaf spring assisted opener for a folding tool such as a folding knife. The folding tool includes tool pivotally carried by a handle. The tool defines a tang at the proximal end. A leaf spring is carried within the handle for assisting in the opening of the tool. The leaf spring defines an elongated, arcuate configuration having a distal end adapted to engage the tang of the tool. When in the closed orientation, the leaf spring is biased toward the tang of the tool, thus holding it in the closed position. The tang of the tool defines a shoulder strategically positioned such that as the tool is pivoted from the closed position, the leaf spring eventually engages the shoulder and begins to release the tension in the leaf spring. At this point, the tension in the spring serves to open the tool the remainder of the rotation.

16 Claims, 6 Drawing Sheets

LEAF SPRING ASSISTED OPENER

BACKGROUND OF THE INVENTION

1. Field of Invention

The present invention pertains to the field of folding tools. More specifically, the present invention is a folding tool, such as a folding knife, having a leaf spring for assisting with opening the tool, and locking the tool in an open position.

2. Description of the Related Art

In the field of tools, folding tools have been known for many years. To this extent, folding knives are also well known. Typically, folding tools are provided with a handle and at least one implement. Each implement is pivotally connected at one end to one end of the handle. The handle is adapted to receive, either internally or externally, each of the implements. The implements include any one or more of a knife blade, a pair of scissors, pliers, eating utensils, screw drivers, and the like.

It is known to provide a means for locking the position of each implement in either or both of a closed and an open position. Further, it is known in the art to provide a means for assisting in the opening and/or closing of the tool. Various devices have been developed to accomplish these and other features of folding tools, and in particular, folding knives. Typical of the art are those devices disclosed in the following U.S. Patents:

| Patent No. | Inventor(s) | Issue Date |
|---|---|---|
| 4,404,748 | G. Wiethoff | Sep. 20, 1983 |
| 5,060,379 | V. O. Neely | Oct. 29, 1991 |
| 5,440,814 | D. K. Hall et al. | Aug. 15, 1995 |
| 5,511,310 | G. C. Sessions et al. | Apr. 30, 1996 |
| 5,802,722 | M. Maxey et al. | Sep. 8, 1998 |
| 6,145,202 | K. J. Onion | Nov. 14, 2000 |
| 6,308,420 | R. L. Moser | Oct. 30, 2001 |
| 6,651,344 | Y. F. Cheng | Nov. 25, 2003 |
| D348,599 | K. Sakai | Jul. 12, 1994 |
| D348,818 | K. Hasegawa | Jul. 19, 1994 |
| D378,982 | L. C. Thompson | Apr. 29, 1997 |
| D473,917 | F. J. Carter III | Apr. 29, 2003 |
| D489,956 | K. Rae | May 18, 2004 |

Of these patents, the '748 patent issued to Wiethoff discloses a folding knife having a handle with a body forming a pocket into which its blade is normally retracted. The pocket is bounded by two sides of the handle traversed by respective contacts in line with a hole near an end of the blade. One cutout receives a plunger which is rigidly connected with a detent, received within the other cutout by a stem that is integral with either the plunger or the detent and traverses the hole of the blade to serve as its pivotal axle. A spring in the first cutout biases the interconnected plunger and detent into a locking position in which a projection on the detent engages in a notch of the blade to hold it in its retracted or its extended position. The biasing spring may bear directly on a confronting blade surface and co-act with one of its notches to prevent a rapid switch into the extended position.

Neely, in his '379 patent, discloses a folding knife apparatus including a blade having a tang secured to a case or housing. Wedging action between the tang and the case locks the blade open and closed. The tang includes a longitudinally extending slot. The housing includes a pin extending through the longitudinally extending slot. A spring is disposed in the slot and biases the blade against the pin to help lock the blade in place, particularly in the open position. Axial movement of the blade is required to unlock the blade from its open position in order to pivot the blade. A cam relationship exists between a portion of the tang and a portion of the case or housing to urge the blade to the closed position.

The '814 patent issued to D. K. Hall et al., discloses a knife comprising a handle, a blade mounted on the handle, and a pair of side guards mounted on the handle and movable between an open position and a closed position. The pair of side guards encloses at least a portion of the blade when in the closed position. An actuating mechanism is provided for actuating the pair of guards between the open position and the closed position. The actuating mechanism includes a button movable between a forward position and a rear position and operable with the pair of side guards such that when the button is in the forward position, the pair of side guards is moved to the open position and when the button is in the rear position, the pair of side guards is moved to the closed position.

Sessions et al., in their '310 patent, disclose a folding knife including a knife blade and a handle for storing the knife blade. A pivotally biased lock bar is provided for securing the blade in an extended position. The handle is formed of two keyed sections firmly assembled together by cooperation of a lock bar biasing spring with coaxially aligned holes formed in the keyed regions of the handle sections. The lock bar biasing spring is biased outwardly against one end of a rocking type lock mechanism. When the knife blade is fully extended, the biasing spring pivots the lock mechanism about a pin, with the opposing end of the lock mechanism engaging the knife blade tang in order to lock the knife blade in the extended position.

In the '722 patent issued to Maxey et al., a one handed knife is disclosed. The '722 knife includes a handle having upper and lower handle portions. An arcuate recess extends through the upper handle portion. A blade lock release extends from the lower handle portion. A blade is pivotally connected between the upper and lower handle portions. A thumb pin extends from the blade. A tension bar having a first and second ends is slidably connected at its first end to the upper handle portion and its second end extends through the arcuate recess and is connected to the blade. When in a closed position, the blade is partially positioned between the upper and lower handle portions, the thumb pin is positioned on a portion of the blade extending from between the upper and lower handle portions, and the tension bar is in a first tensioned position at a first end of the arcuate recess. When in an open position, the blade extends from the handle, the tension bar is in a second untensioned position at a second end of the arcuate recess and the blade lock release is positioned to prevent the blade from pivoting towards the handle. The blade is caused to pivot from the first closed position into the second open position by application of a force on the thumb pin and away from the handle, the force being of a magnitude able to overcome the tension of the tension bar.

Onion, in the '202 patent, teaches a mechanism in a folding knife that urges the blade to move to an open and alternatively to a closed position. The '202 knife includes a blade member having a tang extending outwardly from the blade, a handle having at least one recessed portion, a bar pivotally connecting the tang and the handle, and a bias element engaging the blade wherein the bias element is housed within the recessed portion of the handle. The biasing element is generally a flexible elongated member which, when the blade is closed, is tensioned. When the blade is moved manually a certain distance, the biasing element serves to complete the movement of the blade, as a result of the release of tension and without the application of further outside force by the user.

Moser, in his '420 patent, teaches a folding knife which includes an elongated handle. The elongated handle includes two spaced-apart sides. An elongated blade defines a working end and a tang at the opposite end within a common plane. A pivot including a pivot axis connects the tang to the handle to permit the blade to pivot selectively into an open position at which the blade extends outwardly from the handle and into a closed position in which the blade is nested into the spacing. The blade is provided with a cam secured eccentric to the pivot axis and spaced from the plane that includes the blade. An operating spring is secured at one end to the handle and has abutting contact with the cam remote from the end in the handle thus selectively resisting the pivoting of the blade to an open position and when in an open position resisting the pivoting of the blade to a closed position.

Cheng, in his '344 patent, discloses foldable knife structure which includes a set block disposed within the handle at the pivot point of the blade. The set block defines a detent notch. A spring is situated at the end of the handle opposite the blade pivot. The distal end of the spring extends to engage the set block. When the blade is extended from or folded into the handle, the spring is biased against the circumferential edge of the set block, causing the set block to produce torsion that rotates the blade out of or into a receiving slot of the handle. The spring assists in extending and retracting the blade from the handle.

The remaining design patents each disclose the ornamental design for a folding knife.

BRIEF SUMMARY OF THE INVENTION

The present invention is a leaf spring assisted opener for a folding tool such as a folding knife. The folding tool incorporating the present invention includes generally a handle adapted to receive at least a portion of at least one tool, and the leaf spring assisted opener. The folding tool may include any one or more of a knife blade, a pair of scissors, a pair of pliers, an eating utensil, a screw driver, and the like.

The folding tool includes a handle defining a proximal end and a distal end. The handle may include first and second liners disposed between first and second handle scales. Spacing elements are disposed between the first and second liners and are configured such that a tool receptor is defined within the handle. The various components are secured one to the other in a conventional manner such as with screws. The folding tool further includes a tool such as a knife blade. The tool defines a tang at a proximal end for securing the tool to the proximal end of the handle. When in the closed or retracted position, at least a portion of the tool is received within the tool receptor. When in the open or extended position, the tool is withdrawn from the tool receptor such that it may be used for its intended purpose. A thumb stud is carried on the knife blade to assist in the initial movement of the blade when opening.

A spacing element in the form of a third liner is disposed between the first and second liners. The third liner carries a leaf spring for assisting in the opening of the tool to its extended position. The spacing element and the leaf spring may either be integrally formed, or separately fabricated. In the latter embodiment, the spacing element defines a receptor for closely receiving the proximal end of a leaf spring.

The leaf spring defines an elongated, arcuate configuration. The curve of the leaf spring is toward the tool. The distal end of the leaf spring is adapted to engage the tang of the tool. When in the closed orientation, the leaf spring is biased toward the tang of the tool as a result of the leaf spring being under tension. As a result of the bias, the tool is held in the closed position.

The tang of the tool defines a shoulder strategically positioned such that as the tool is pivoted from the closed position, the leaf spring eventually engages the shoulder and begins to release the tension in the leaf spring. The tool is manually pivoted through at least a portion of the rotation in order to initiate the opening of the tool. Manual opening is required through this degree of rotation in order to overcome the bias of the leaf spring which, without manual force, serves to maintain the tool in a closed orientation. At the point where the leaf spring initiates engagement with the shoulder, the tension in the spring serves to open the tool the remainder of the rotation. After the leaf spring has engaged and then instantly become disengaged from a notch defined in the tang, the tool has gained sufficient momentum to continue through the reorientation to the open position. This momentum is created through the release of the tension in the leaf spring.

The folding tool further includes a locking mechanism such as a conventional liner lock. After the tool has been extended and locked, the tool is reoriented to the closed position using essentially the reverse of the described steps. First, the locking mechanism is engaged to unlock the position of the tool. The tool is then manually reoriented to the closed position. As the tool is being so reoriented, the leaf spring is tensioned in order to assist in subsequently opening the tool again. Once the tool has been rotated through a degree such that the distal end of the leaf spring is not engaged with the tang shoulder, the leaf spring is substantially fully tensioned, thereby allowing the leaf spring to assist in closing and locking the tool in a closed position.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
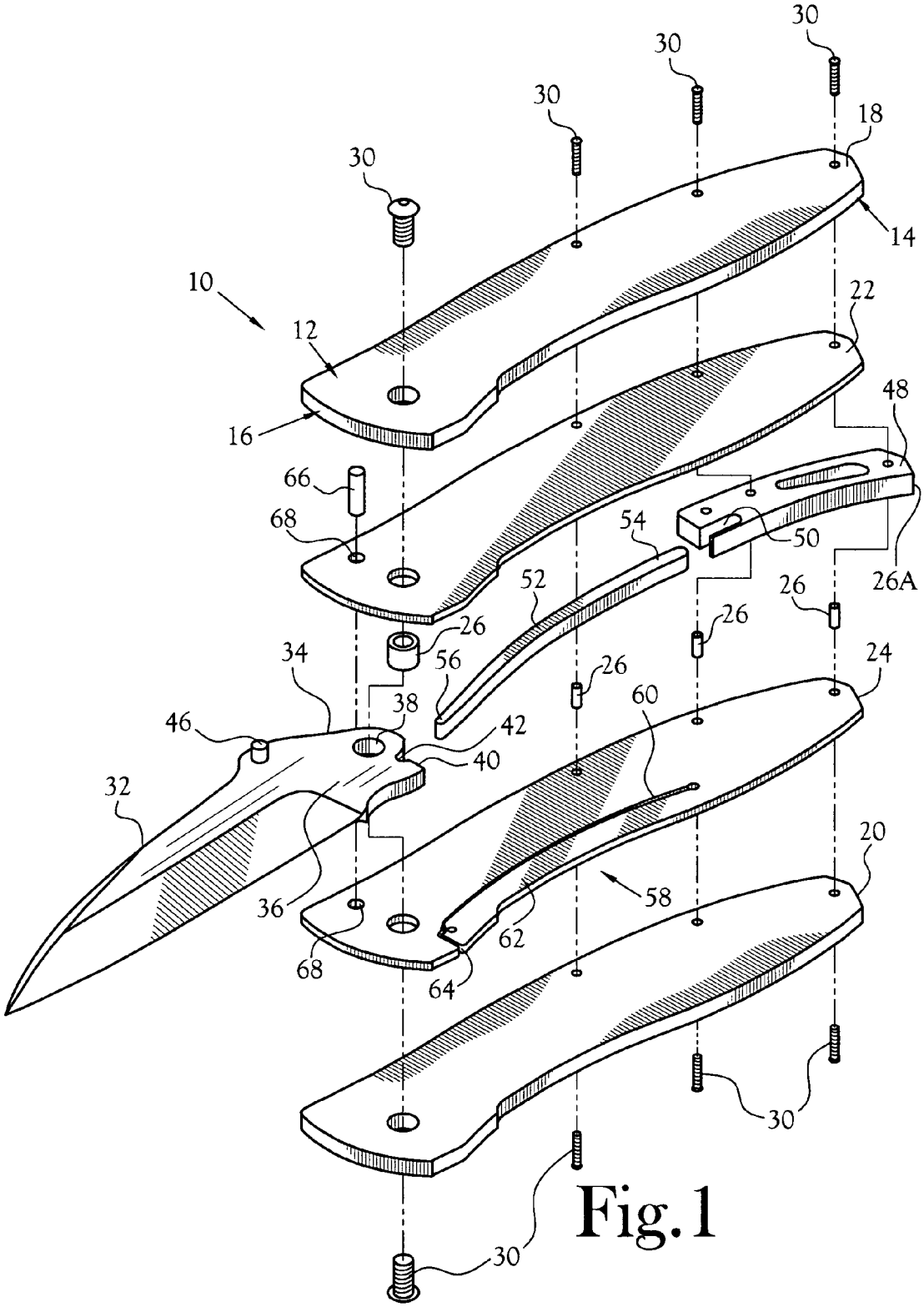
FIG. 1 is an exploded view, in perspective, of the folding tool incorporating the leaf spring assisted opener of the present invention.

A leaf spring assisted opener for a folding tool such as a folding knife is disclosed. The folding tool incorporating the present invention is shown generally at 10 in the Figures. The folding tool 10 includes generally a handle 12 adapted to receive at least a portion of at least one tool 32, and a leaf spring 52 for assisting in the opening of the tool 32. While described and illustrated herein as a folding knife, it will be understood that the folding tool 10 may include any one or more of the aforementioned conventional tools 32 including, but not limited to, a knife blade, a pair of scissors, a pair of pliers, an eating utensil, a screw driver, and the like.

Figure 2:
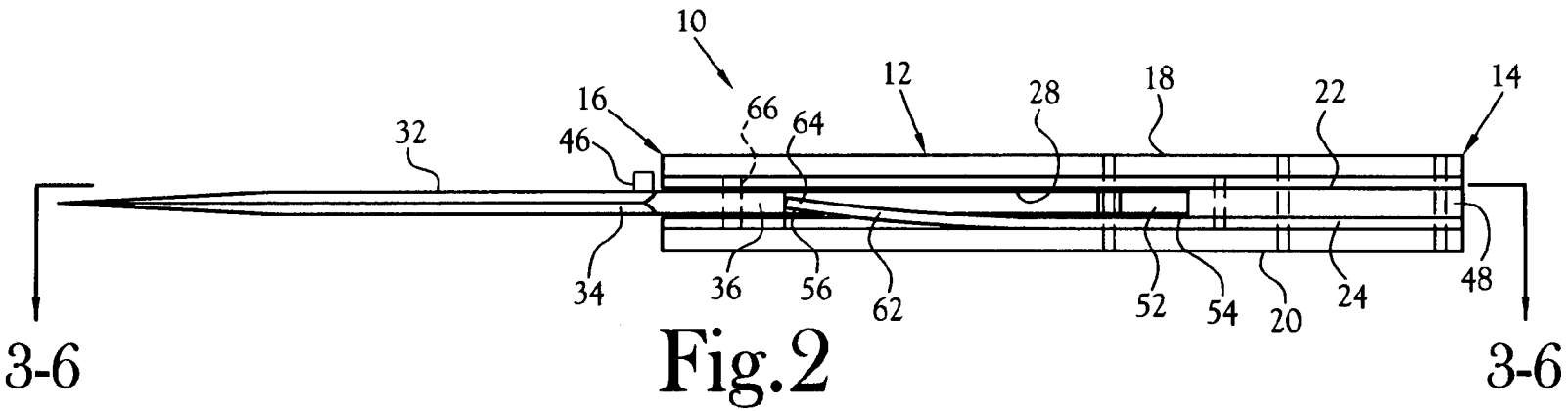
FIG. 2 is a front elevation view of the folding tool incorporating the leaf spring assisted opener of the present invention.

An exploded view showing the various components of the folding tool 10 of the present invention is illustrated in FIG. 1. The assembled knife is illustrated in FIG. 2. The folding tool 10 of the illustrated embodiment includes a handle 12 defining a proximal end 14 and a distal end 16. The handle 12 generally includes first and second handle scales 18,20, at least first and second liners 22,24 disposed between the first and second handle scales 18,20, and at least one spacing element 26 disposed between the first and second liners 22,24. As will be discussed in relation to an alternate embodiment described below, the first and second liners 22,24 may be omitted from the design of the folding tool 10 of the present invention without departing from the scope of the present invention. The spacing elements 26 are configured such that a tool receptor 28 (see FIG. 2) is defined within the handle 12. The various components are secured one to the other in a conventional manner such as with screws 30.

The folding tool 10 further includes a tool 32 such as the illustrated knife blade. The tool 32 defines a tang 36 at a proximal end 34 for securing the tool 32 to the distal end 16 of the handle 12. The tang 36 defines a through opening 38 through which a fastener 30 is received in such a manner as to limit movement of the tool 32 to pivotal movement between a closed and an open position. When in the closed or retracted position, at least a portion of the tool 32 is received within the tool receptor 28. When in the open or extended position, the tool 32 is withdrawn from the tool receptor 28 such that it may be used for its intended purpose.

In the illustrated embodiment, a thumb stud 46 is carried on the knife blade 32 proximate the proximal end 34 thereof. The thumb stud 46 is engaged by the user in order to assist in the initial movement of the blade when opening. While a thumb stud 46 has been illustrated and described, it will be understood that other conventional opener configurations may be incorporated as well. These include, but are not limited to, a notch (not illustrated) formed in an exposed portion of the tool 32 when in the closed position, and an extended portion formed on or carried by the tool 32 and extending from the handle 12 when the tool 32 is in the closed position.

A tool stop 66 is disposed between the first and second handle scales 18,20 at the distal end 16 of the handle 12. Each of the first and second liners 22,24 defines an opening 68 for closely receiving one end of the tool stop 66. When the tool 32 is extended to the open position, the tang 36 engages the tool stop 66, thereby preventing further rotation of the tool 32.

Figure 3A:
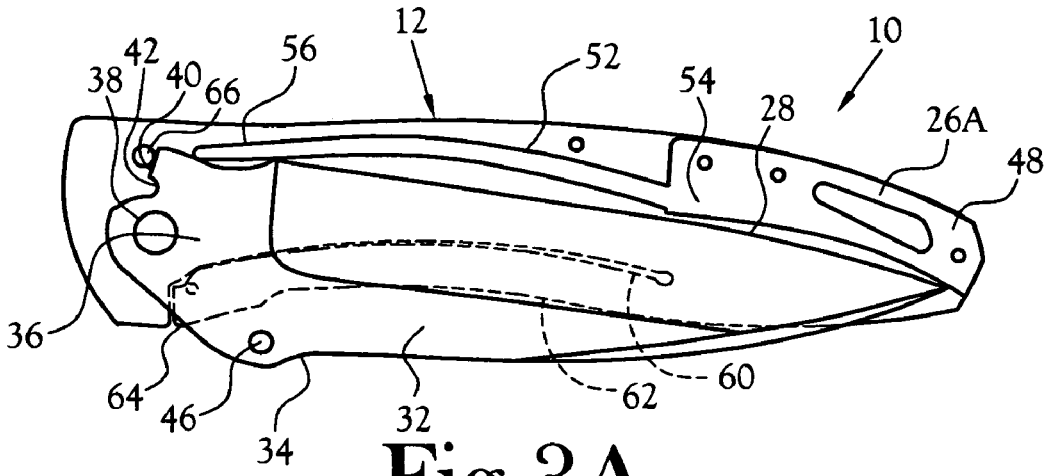
FIG. 3A is a top plan view of the folding tool incorporating the present invention, showing the first handle scale and the first liner removed, showing the tool in the closed orientation, and showing the third liner defining an integral spacing element and leaf spring.
Figure 3B:
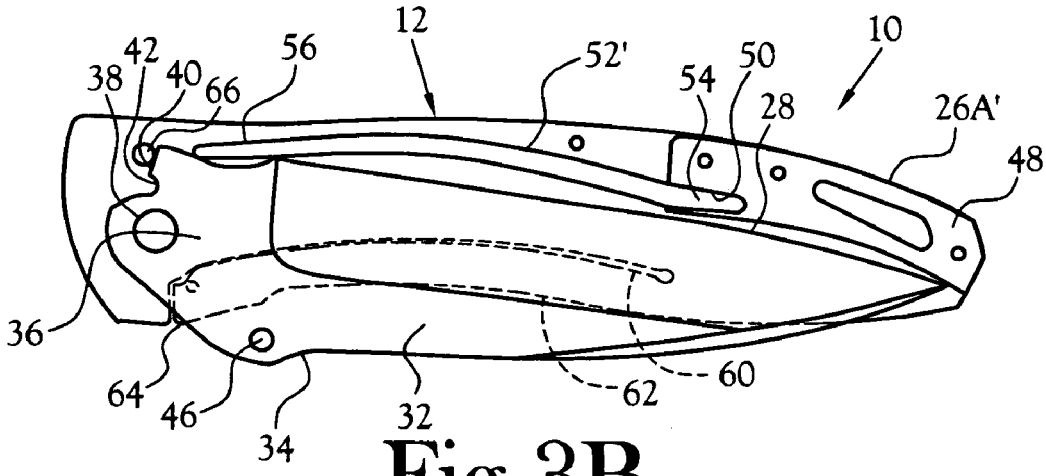
FIG. 3B is a top plan view of an alternate embodiment of the folding tool of FIG. 3A, wherein the third liner defines a separable spacing element and leaf spring.

FIGS. 3A and 3B illustrate alternate embodiments of the folding tool 10 incorporating the present invention, showing the first handle scale 18 and the first liner 22 removed. A third liner 48 is disposed between the first and second liners 22,24. The third liner 48 serves as a spacing element 26A at the proximal end 14 of the handle 12. The third liner 48 carries a leaf spring 52 for assisting in the opening of the tool 32 to its extended position. In the illustrated embodiment of FIG. 3A, the spacing element 26A and the leaf spring 52 are integrally formed.

In the illustrated embodiment of FIG. 3B, the spacing element 26A' defines a receptor 50 for closely receiving the proximal end 54 of a leaf spring 52'. In the latter embodiment, it will be understood that the materials of manufacture of each of the spacing element 26A' and the leaf spring 52' are more readily variable as each is manufactured individually. To this extent, the proximal end 54 of the leaf spring 52' may be either permanently or removably received within the spacing element receptor 50. In the instance whereby the leaf spring 52' is removably received within the spacing element receptor 50, the tension on the leaf spring 52' serves to retain the leaf spring 52' within the receptor 50.

The leaf spring 52 defines an elongated, arcuate configuration. The curve of the leaf spring 52 is toward the tool 32. The distal end 56 of the leaf spring 52 is adapted to engage the tang 36 of the tool 32. The leaf spring 52 is fabricated such that it is biased toward the tool 32. When in the closed orientation, as illustrated in FIG. 3A, the leaf spring 52 is biased toward the tang 36 of the tool 32 as a result of the leaf spring 52 being under tension. As a result of the bias, the tool 32 is held in the closed position.

Figure 4:
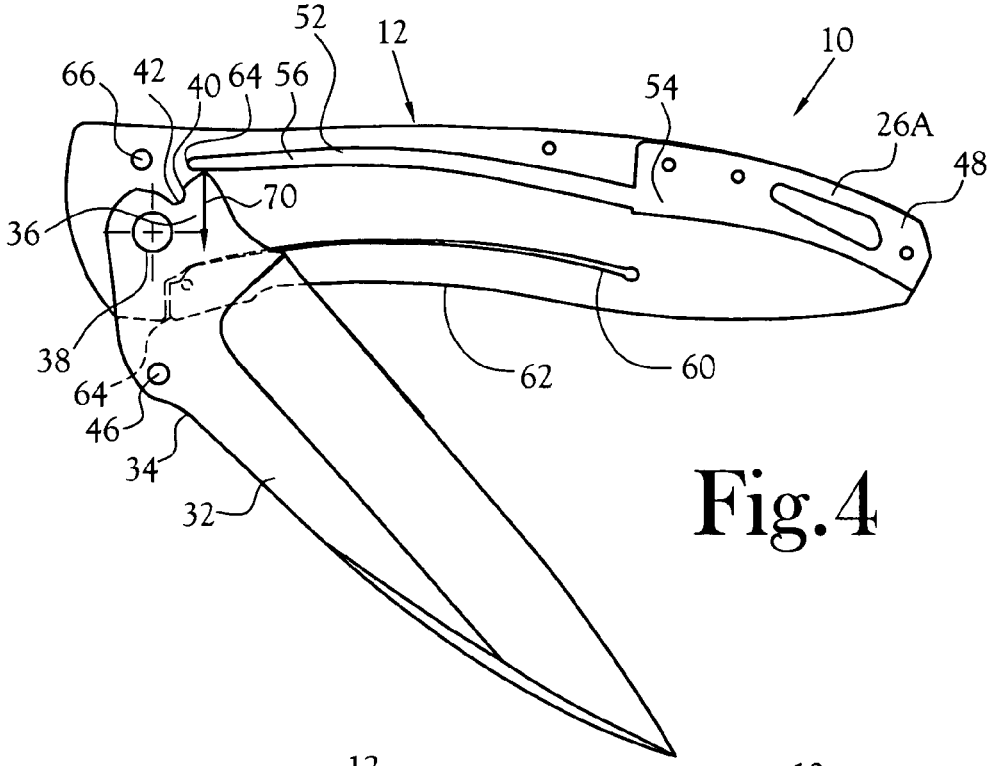
FIG. 4 is a top plan view of the folding tool of FIG. 3A wherein the tool has been manually rotated through a selected degree of rotation until the leaf spring assisted opener initiates automatic rotation of the tool.

The tang 36 of the tool 32 defines a shoulder 40 strategically positioned such that as the tool 32 is pivoted from the closed position, the leaf spring 52 eventually engages the shoulder 40 and begins to release the tension in the leaf spring 52. It is at this point that the force applied to the tang 36, as illustrated at 70, is eccentric to the pivot point of the tool 32 and the radius from the point at which the spring 52 engages the tang 36 begins to be reduced. In the illustrated embodiment of FIG. 4, this occurs at approximately 45° rotation of the tool 32. FIG. 4 illustrates the folding tool 10 of FIG. 3A wherein the tool 32 has been manually opened until the leaf spring 52 begins to assist in opening the tool 32. While an approximate 45° rotation of the tool 32 is illustrated as initiating the assisted opening, it will be understood that this may be varied by selectively configuring and positioning the shoulder 40. The tool 32 is manually pivoted through at least this portion of the rotation in order to initiate the opening of the tool 32. Manual opening is required through this degree of rotation in order to overcome the bias of the leaf spring 52 which, without manual force, serves to maintain the tool 32 in a closed orientation.

Figure 5:
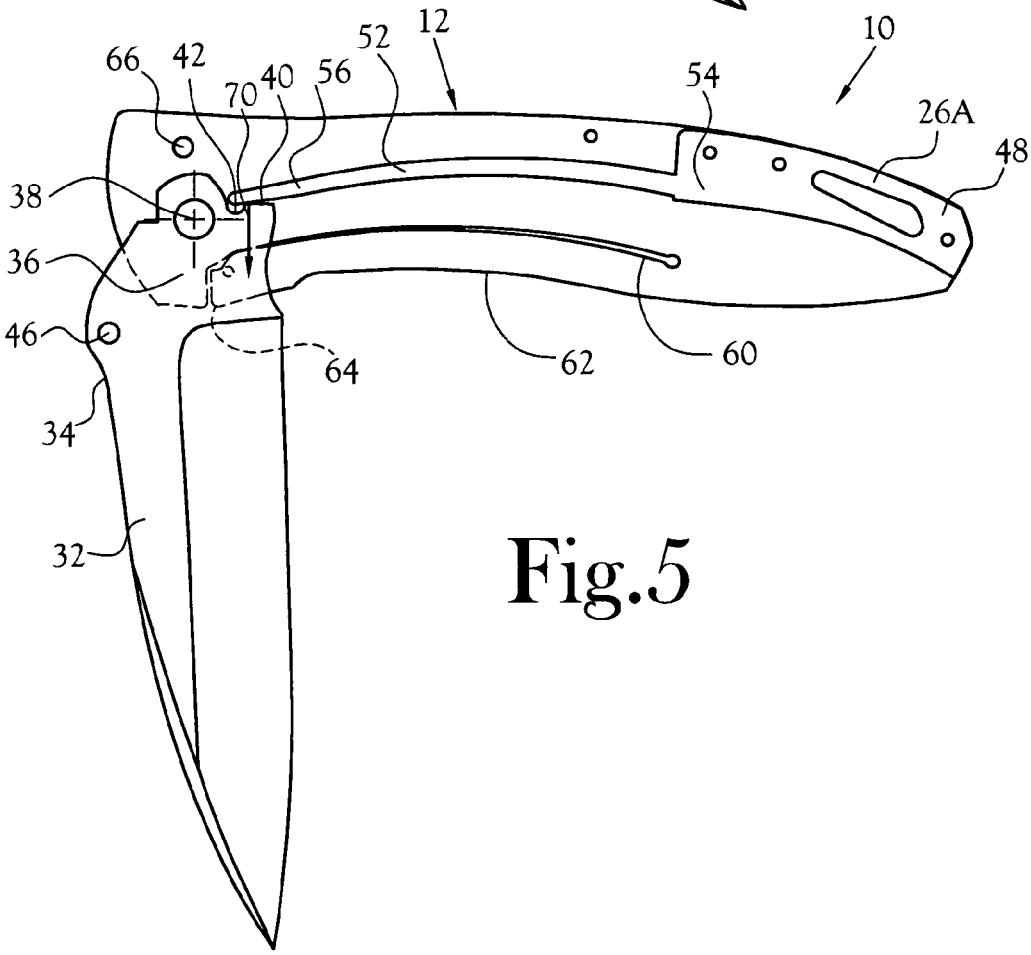
FIG. 5 is a top plan view of the folding tool of FIG. 3A wherein the leaf spring assisted opener has been engaged with the tool, which has been rotated through a selected degree of rotation until the leaf spring contacts a notch defined in the tool tang.

At the point where the leaf spring 52 initiates engagement with the shoulder 40, the tension in the leaf spring 52 serves to open the tool 32 the remainder of the rotation. As illustrated in FIG. 5, the tang 36 further defines a notch 42 at the interior end of the shoulder 40, the notch 42 being configured to receive the distal end 56 of the leaf spring 52 as the tool 32 continues its rotation to the open position and the leaf spring 52 continues to release stored energy.

Figure 6:
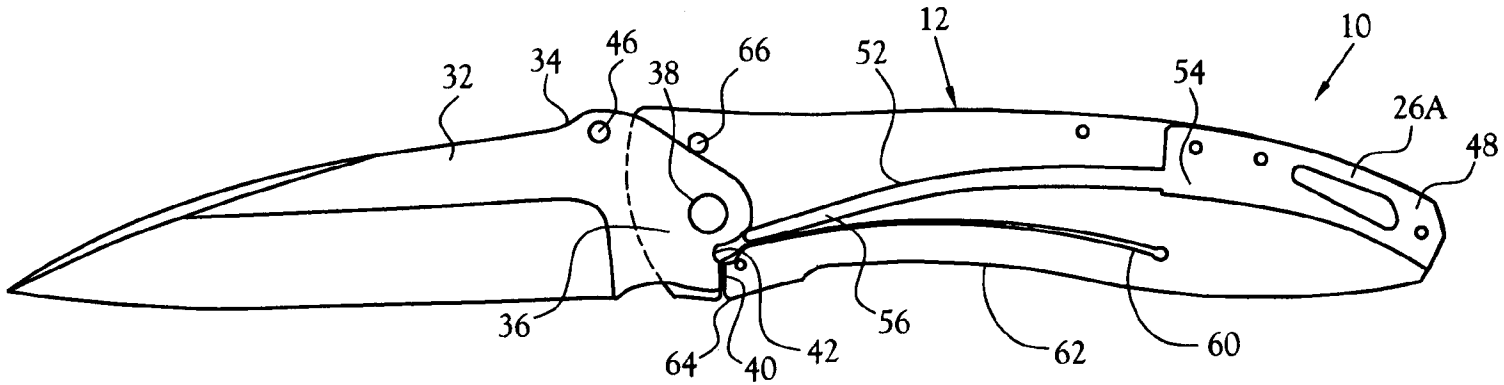
FIG. 6 is a top plan view of the folding tool of FIG. 3A wherein the leaf spring assisted opener has been engaged with the tool and the tool has been fully extended until a locking mechanism has been engaged.

Finally, as illustrated in FIG. 6, after the leaf spring 52 has engaged and then instantly become disengaged from the notch 42, the tool 32 has gained sufficient momentum to continue through the reorientation to the open position. This momentum is created through the release of the tension in the leaf spring 52. While manual intervention can allow the tool 32 to be opened without fully extending the tool 32 to the open position, by not manually intervening the tool 32 is allowed to fully extend to the open position and engage a locking mechanism 58, thereby preventing accidental closure of the tool.

To this extent, in the illustrated embodiment, the folding tool 10 further includes a locking mechanism 58. The illustrated locking mechanism 58 is a conventional liner lock. In the second liner 24, a longitudinal slot 60 is formed to define an elongated spring 62. The elongated spring 62 is manipulated such that a distal end 64 thereof, corresponding to the proximal end 14,34 of each of the handle 12 and the tool 32, is biased toward a plane in which the tool 32 is disposed. The distal end 64 of the elongated spring 62 engages the tang 36 of the tool 32 until the tool 32 is extended completely into the open position. To this extent, the elongated spring distal end 64 of the elongated spring 62 engages the shoulder 40 when tool 32 is extended completely into the open position. When the tool 32 is moved to the open position, the bias of the elongated spring 62 causes the distal end 64 thereof to move into the plane in which tang 36 of the tool 32 is disposed and engage the shoulder 40 of the tang 36. When such engagement is accomplished, the tool 32 is locked in the open position. The tool stop 66 and the locking mechanism 58 thus cooperate to prevent rotation of the tool 32 in either direction when the 32 is extended to the open position.

In order to disengage the elongated spring 62 from the tang 36 in order to reorient the tool 32 in the closed position, the user engages the elongated spring distal end 64 and moves it out of the plane in which the tang 36 of the tool 32 is disposed and then pivots the tool back to it closed position. To this extent, a portion of the distal end 64 of the elongated spring 62 is accessible to the user through the tool receptacle 28 defined in the handle 12.

While a particular locking mechanism 58 has been illustrated and described, it will be understood that other conventional as well as yet to be discovered locking mechanisms 58 may be incorporated in a folding tool 10 which also incorporates the leaf spring assisted opener of the present invention.

After the tool 32 has been extended and locked as described, the tool 10 is reoriented to the closed position using essentially the reverse of the described steps. First, the locking mechanism 58 is engaged to unlock the position of the tool 32. The tool 32 is then manually reoriented to the closed position. As the tool 32 is being so reoriented, the leaf spring 52 is tensioned in order to assist in subsequently opening the tool 32 again. Once the tool 32 has been rotated through a degree such that the distal end 56 of the leaf spring 52 is not engaged with the tang shoulder 40, the leaf spring 52 is substantially fully tensioned, thereby allowing the leaf spring 52 to assist in closing and locking the tool 32 in a closed position.

Figure 7:
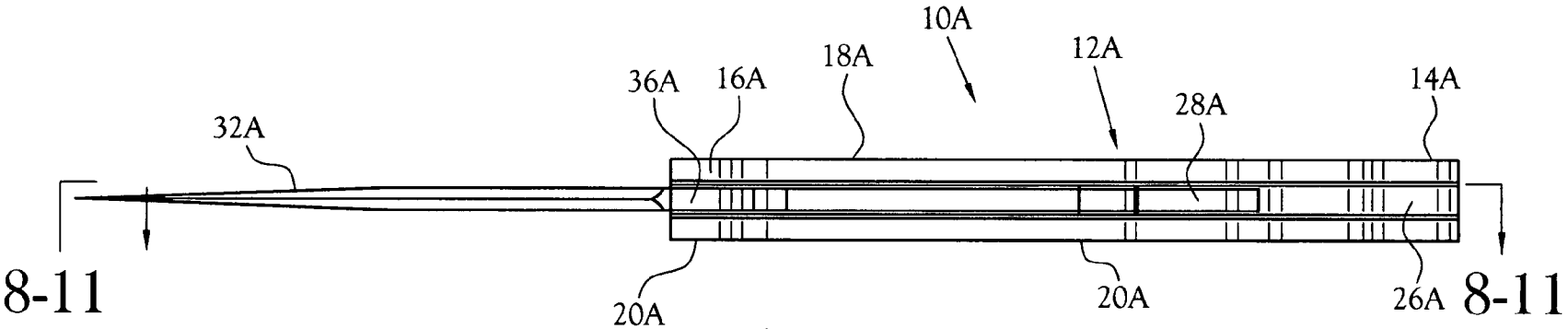
FIG. 7 is a front elevation view of a folding tool incorporating an alternate embodiment of the leaf spring assisted opener of the present invention.

FIGS. 7–11 illustrate a further embodiment of the present invention. As illustrated in FIG. 7, the folding tool 10A includes a handle 12A defining a proximal end 14A and a distal end 16A. The handle 12A generally includes first and second handle scales 18A,20A and at least one spacing element 26A disposed between the first and second handle scales 18A,20A. In this embodiment, the first and second liners 22,24 of the previous embodiment is omitted. The spacing element 26A is configured such that a tool receptor 28A is defined within the handle 12A.

The folding tool 10A further includes a tool 32A such as the illustrated knife blade. The tool 32A defines a tang 36A at a proximal end 34A for securing the tool 32A to the distal end 16A of the handle 12A.

A tool stop 66A is disposed between the first and second handle scales 18A,20A at the distal end 16A of the handle 12A. When the tool 32A is extended to the open position, the tang 36A engages the tool stop 66A, thereby preventing further rotation of the tool 32A.

FIGS. 8–11 illustrate the folding tool 10A incorporating the present invention, showing the first handle scale 18A removed. The spacing element 26A defines a receptor 50A for closely receiving the proximal end 54A of a leaf spring 52A. The proximal end 54A of the leaf spring 52A may be either permanently or removably received within the spacing element receptor 50A. In the instance whereby the leaf spring 52A is removably received within the spacing element receptor 50A, the tension on the leaf spring 52A serves to retain the leaf spring 52A within the receptor 50A.

Figure 8:
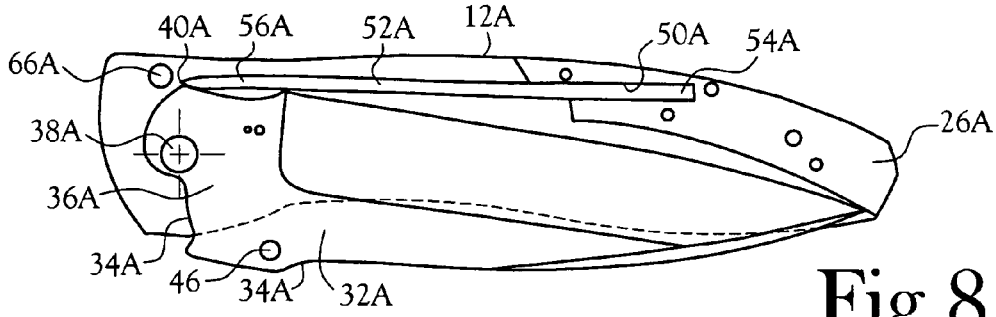
FIG. 8 is a top plan view of the folding tool of FIG. 7 incorporating an alternate embodiment of the present invention, showing the first handle scale and the first liner removed, showing the tool in the closed orientation.

The distal end 56A of the leaf spring 52A is adapted to engage the tang 36A of the tool 32A. The leaf spring 52A is fabricated such that it is biased toward the tool 32A. When in the closed orientation, as illustrated in FIG. 8, the leaf spring 52A is biased toward the tang 36A of the tool 32A as a result of the leaf spring 52A being under tension. As a result of the bias, the tool 32A is held in the closed position.

Figure 11:
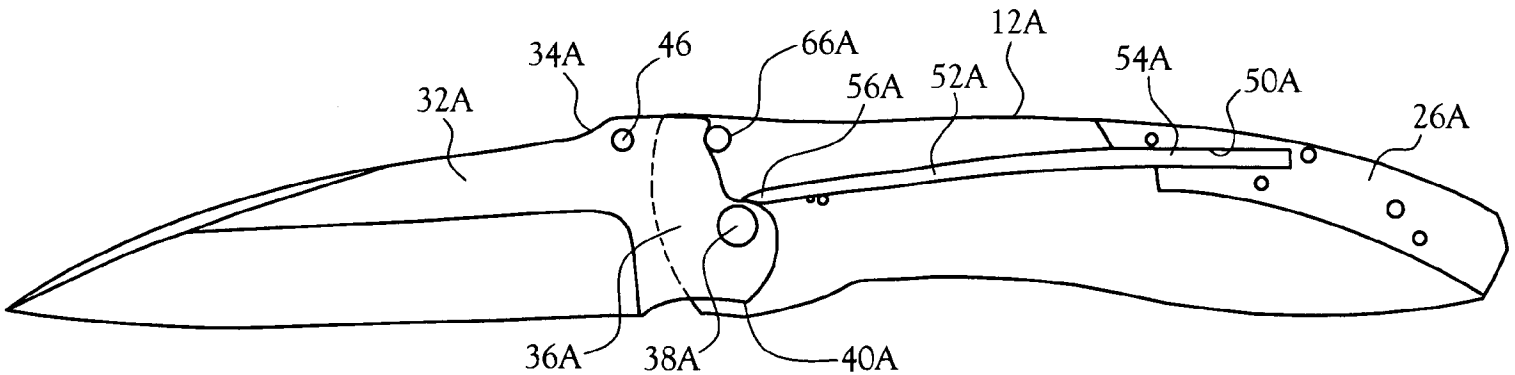
FIG. 11 is a top plan view of the folding tool of FIG. 8 wherein the leaf spring assisted opener has been engaged with the tool and the tool has been fully extended.
Figure 9:
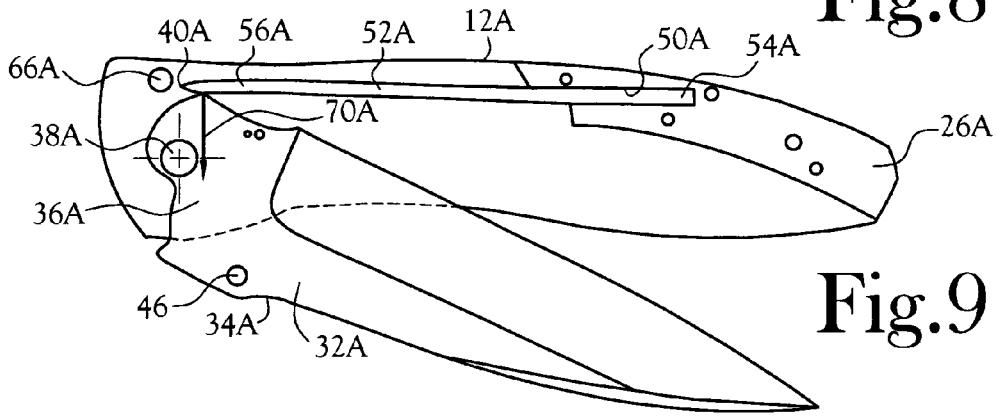
FIG. 9 is a top plan view of the folding tool of FIG. 8 wherein the tool has been manually rotated through a selected degree of rotation until the leaf spring assisted opener initiates automatic rotation of the tool.
Figure 10:
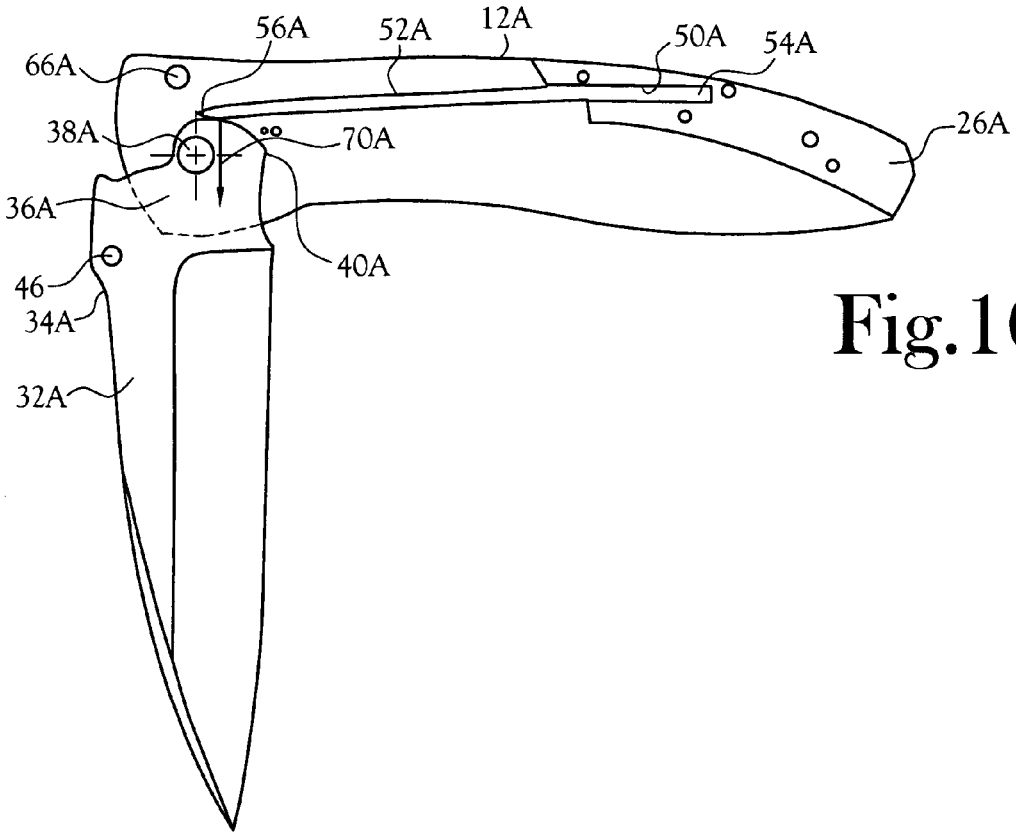
FIG. 10 is a top plan view of the folding tool of FIG. 8 wherein the leaf spring assisted opener has been engaged with the tool, which has been rotated through a selected degree of rotation.

The tang 36A of the tool 32A defines a point 40A strategically positioned such that as the tool 32A is pivoted from the closed position, the leaf spring 52A moves past the point 40A and begins to release the tension in the leaf spring 52A. Referring to FIG. 9, it is at this point that the force applied to the tang 36A, as illustrated at 70A, is eccentric to the pivot point of the tool 32A and the radius from the point at which the spring 52A engages the tang 36A begins to be reduced. This radius continuously reduces from the point 40A until the tool 32A is moved fully to the open position, as illustrated in FIG. 11. In the illustrated embodiment, this occurs at approximately 22° rotation of the tool 32A. FIG. 9 illustrates the folding tool 10A wherein the tool 32A has been manually opened until the leaf spring 52A begins to assist in opening the tool 32A. The tool 32A is manually pivoted through at least this portion of the rotation in order to initiate the opening of the tool 32A.

As illustrated in FIG. 11, when the tool 32A is moved to the open position, the distal end 56A of the spring 52A remains engaged to the tang 36A. As such, the bias of the spring 52A serves to retain the tool 32A in the open position.

From the foregoing description, it will be recognized by those skilled in the art that a leaf spring assisted opening device for a folding tool has been provided. The leaf spring assisted opener of the present invention is incorporated in a folding tool, such as a folding knife. The leaf spring assisted opener is configured first to maintain the folding tool in a locked position when closed, and second to assist in opening the tool into a fully-extended and locked open position after manual opening through a pre-selected degree of rotation. After the tool has been opened through a selected degree of rotation, the leaf spring assisted opener opens the tool through the remainder of the rotation.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

I claim:

1. A folding tool comprising:

a handle defining a proximal end and a distal end, said handle including a first handle scale and a second handle scale;

at least one spacing element disposed between and adapted to engage each of said first handle scale and said second handle scale, said at least one spacing element being provided for spacing said first handle scale and said second handle scale apart, said at least one spacing element including at least a distal end spacing element;

a first liner and a second liner, said first liner being disposed between said first handle scale and said at least one spacing element, said second liner being disposed between said second handle scale and said at least one spacing element;

a tool receptor defined between said first handle scale and said second handle scale;

a tool element carried by said handle, said tool element defining a tang at a proximal end for securing said tool element to said distal end of said handle, said tool element being limited to pivotal movement between a closed position at which at least a portion of said tool element is received within said tool receptor and an open position at which said tool element is withdrawn from said tool receptor, said tool element tang defining a through opening configured to receive said distal end spacing element, said distal end spacing element further being provided to serve as a bearing for said tool element for facilitating pivotal movement thereof;

a proximal end spacing element disposed between said first handle scale and said second handle scale at said handle proximal end; and a leaf spring for assisting in rotating said tool element to said open position, said leaf spring defining an elongated, arcuate configuration having a proximal end and a distal end, said proximal end of said leaf spring being carried by said proximal end spacing element, said distal end of said leaf spring being adapted to engage said tang of said tool element, said leaf spring defining a bias toward said tool element.

2. The folding tool of claim 1 wherein said tool element tang defines a point at which a radius from said point to a pivot point of said tool element begins a continuous reduction, said point being positioned such that after said tool element is pivoted from said closed position through a selected degree of rotation toward said open position, said leaf spring distal end applies a force on said tang eccentric to said pivot point, whereby said bias causes said tool element to continue pivoting to said open position.

3. The folding tool of claim 1 further comprising a locking mechanism for selectively locking said tool element in said open position.

4. The folding tool of claim 3 further comprising at least one liner disposed between one of said first handle scale and said second handle scale, said at least one liner defining a longitudinal slot to define an elongated spring having a distal end, said locking mechanism being comprised of said elongated spring, said elongated spring being adapted such that said elongated spring distal end is biased toward a plane in which said tool element is disposed, said elongated spring distal end being configured to engage said tool element tang until said tool element is extended completely into said open position, said tool element tang defining a locking mechanism shoulder for engaging said elongated spring distal end when said tool element is moved to said open position, said elongated spring distal end being biased into said plane in which said tool element tang is disposed and engaging said locking mechanism shoulder of said tool element tang, whereby movement of said tool element toward said closed position is selectively prevented.

5. The folding tool of claim 1 wherein said proximal end spacing element and said leaf spring are integrally formed.

6. The folding tool of claim 1 wherein said proximal end spacing element defines a receptor for closely receiving said leaf spring proximal end.

7. The folding tool of claim 1 wherein said tool element is a knife blade.

8. The folding tool of claim 1 further comprising an initial opening assist device for assisting in initial movement of said tool element and until said tool element is moved toward said open position to a point where said leaf spring is actuated to rotate said tool element to said open position.

9. The folding tool of claim 8 wherein said initial opening assist device is a thumb stud carried by said proximal end of said tool element.

10. A folding tool comprising:

a handle defining a proximal end and a distal end, said handle including a first handle scale and a second handle scale;

at least one spacing element disposed between and adapted to engage each of said first handle scale and said second handle scale, said at least one spacing element being provided for spacing said first handle scale and said second handle scale apart, said at least one spacing element including at least a distal end spacing element;

a first liner and a second liner, said first liner being disposed between said first handle scale and said at least one spacing element, said second liner being disposed between said second handle scale and said at least one spacing element;

a tool receptor defined between said first handle scale and said second handle scale;

a tool element carried by said handle, said tool element defining a tang at a proximal end for securing said tool element to said distal end of said handle, said tool element being limited to pivotal movement between a closed position at which at least a portion of said tool element is received within said tool receptor and an open position at which said tool element is withdrawn from said tool receptor, said tool element tang defining a point at which a radius from said point to a pivot point of said tool element begins a continuous reduction, said tool element tang defining a through opening configured to receive said distal end spacing element, said distal end spacing element further being provided to serve as a bearing for said tool element for facilitating pivotal movement thereof;

a proximal end spacing element disposed between said first handle scale and said second handle scale at said handle proximal end;

a leaf spring for assisting in rotating said tool element to said open position, said leaf spring defining an elongated, arcuate configuration having a proximal end and a distal end, said proximal end of said leaf spring being carried by said proximal end spacing element, said distal end of said leaf spring being adapted to engage said tang of said tool element, said leaf spring defining a bias toward said tool element, wherein said point of said tool element tang is positioned such that after said tool element is pivoted from said closed position through a selected degree of rotation toward said open position, said leaf spring distal end applies a force on said tang eccentric to said pivot point, whereby said bias causes said tool element to continue pivoting to said open position; and a locking mechanism for selectively locking said tool element in said open position.

11. The folding tool of claim 10 further comprising at least one liner disposed between one of said first handle scale and said second handle scale, said at least one liner defining a longitudinal slot to define an elongated spring having a distal end, said locking mechanism being comprised of said elongated spring, said elongated spring being adapted such that said elongated spring distal end is biased toward a plane in which said tool element is disposed, said elongated spring distal end being configured to engage said tool element tang until said tool element is extended completely into said open position, said tool element tang defining a locking mechanism shoulder for engaging said elongated spring distal end when said tool element is moved to said open position, said elongated spring distal end being biased into said plane in which said tool element tang is disposed and engaging said locking mechanism shoulder of said tool element tang, whereby movement of said tool element toward said closed position is selectively prevented.

12. The folding tool of claim 10 wherein said proximal end spacing element and said leaf spring are integrally formed.

13. The folding tool of claim 10 wherein said proximal end spacing element defines a receptor for closely receiving said leaf spring proximal end.

14. The folding tool of claim 10 wherein said tool element is a knife blade.

15. The folding tool of claim 10 further comprising an initial opening assist device for assisting in initial movement of said tool element and until said tool element is moved toward said open position to a point where said leaf spring is actuated to rotate said tool element to said open position.

16. The folding tool of claim 15 wherein said initial opening assist device is a thumb stud carried by said proximal end of said tool element.

* * * * *